US011417952B2

(12) United States Patent
Wang

(10) Patent No.: US 11,417,952 B2
(45) Date of Patent: Aug. 16, 2022

(54) ANTENNA DEVICE AND ELECTROSTATIC DISCHARGE PROTECTION METHOD THEREOF

(71) Applicant: PEGATRON CORPORATION, Taipei (TW)

(72) Inventor: Chih-Wei Wang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/024,582

(22) Filed: Sep. 17, 2020

(65) Prior Publication Data

US 2021/0151872 A1 May 20, 2021

(30) Foreign Application Priority Data

Nov. 18, 2019 (TW) ..... 108141815

(51) Int. Cl.
*H01Q 1/50* (2006.01)
*H01Q 1/00* (2006.01)

(52) U.S. Cl.
CPC ..... *H01Q 1/50* (2013.01); *H01Q 1/002* (2013.01)

(58) Field of Classification Search
CPC ..... H01Q 1/50; H01Q 1/002; H01Q 21/0006; H01Q 23/00; H01L 27/02
See application file for complete search history.

(56) References Cited

U.S. PATENT DOCUMENTS 7,295,814 B2 11/2007 Yamashita et al.
8,970,323 B2 3/2015 Bakalski et al.
2011/0028114 A1* 2/2011 Kerselaers ..... H04B 1/18 455/296
2013/0187807 A1* 7/2013 Peng ..... H01Q 3/24 342/175
2013/0215808 A1* 8/2013 Muthukrishnan ..... H02H 9/046 370/297
2014/0315497 A1* 10/2014 Wu ..... H04B 1/40 455/73
2018/0323752 A1* 11/2018 Wallis ..... H03F 3/195

FOREIGN PATENT DOCUMENTS

TW I241785 10/2005
TW I514675 12/2015
TW I615618 2/2018

* cited by examiner

*Primary Examiner* — Andrea Lindgren Baltzell
*Assistant Examiner* — Yonchan J Kim
(74) *Attorney, Agent, or Firm* — J.C. Patents

(57) ABSTRACT

An antenna device with an electrostatic discharge protection function and an electrostatic discharge protection method thereof are provided. The antenna device includes a first and a second antennae, and a voltage level, a switching, and a radio frequency (RF) front end circuits. The switching circuit is selectively coupled to the first or second antenna. The RF front end circuit is coupled to the switching circuit and controls the switching circuit to couple to one of the first and second antennae for communication transmission. The voltage level circuit detects a voltage level of the one of the first and second antennae. When determining that the voltage level is greater than a threshold voltage, the voltage level circuit transmits a control signal to the RF front end circuit to control the switching circuit to couple to another one of the first and second antennae to continue the communication transmission.

10 Claims, 2 Drawing Sheets

ANTENNA DEVICE AND ELECTROSTATIC DISCHARGE PROTECTION METHOD THEREOF

CROSS-REFERENCE TO RELATED APPLICATION

This application claims the priority benefit of Taiwan application serial no. 108141815, filed on Nov. 18, 2019. The entirety of the above-mentioned patent application is hereby incorporated by reference herein and made a part of this specification.

BACKGROUND

1. Technical Field

The disclosure relates to an antenna device, and in particular, to an antenna device with an electrostatic discharge protection function and an electrostatic discharge protection method thereof.

2. Description of Related Art

In order to meet the needs of modern people, a current electronic product is provided with more functions, so that electrostatic discharge (ESD) is increasingly complicated. Therefore, almost all current electronic products need to undergo relevant electrostatic discharge tests. However, especially for an electronic product equipped with an antenna device, because electrostatic discharge has a great influence on the antenna device, the electronic product equipped with the antenna device must be designed to overcome the electrostatic discharge during development. For example, for an electronic product equipped with a Wi-Fi device, because an antenna of the Wi-Fi device is often placed close to an exterior of the electronic product, the antenna of the Wi-Fi device is easily hit by electrostatic current, causing mis-operation or a functional damage. In view of this, solutions of several embodiments are provided below.

SUMMARY

The disclosure provides an antenna device with an electrostatic discharge protection function and an electrostatic discharge protection method thereof, which can provide an effective electrostatic discharge protection effect.

An antenna device with an electrostatic discharge protection function of the disclosure includes a first antenna, a second antenna, a voltage level circuit, a switching circuit, and a radio frequency (RF) front end circuit. The switching circuit is selectively coupled to the first antenna or the second antenna. The RF front end circuit is coupled to the switching circuit and is configured to control the switching circuit to couple to one of the first antenna and the second antenna for communication transmission. The voltage level circuit is coupled to the first antenna and the second antenna. The voltage level circuit is configured to detect a voltage level of the one of the first antenna and the second antenna, and is configured to determine whether the voltage level is greater than a threshold voltage. When determining that the voltage level is greater than the threshold voltage, the voltage level circuit transmits a control signal to the RF front end circuit to control the switching circuit to couple to the other of the first antenna and the second antenna to continue the communication transmission.

An electrostatic discharge protection method of an antenna device of the disclosure includes the following steps. An RF front end circuit controls a switching circuit to couple to a first antenna or a second antenna. A voltage level circuit detects a voltage level of one of the first antenna and the second antenna, and determines whether the voltage level is greater than a threshold voltage. The voltage level circuit transmits a control signal to the RF front end circuit when the voltage level circuit determines that the voltage level is greater than the threshold voltage, to control the switching circuit to couple to another one of the first antenna and the second antenna to continue the communication transmission.

Based on the foregoing, the antenna device with the electrostatic discharge protection function and the electrostatic discharge protection method thereof of the disclosure may detect whether the antenna under communication transmission receives the electrostatic discharge energy, to immediately disconnect the antenna that receives the electrostatic discharge energy, thereby achieving a good electrostatic discharge protection effect, and performing switching immediately to maintain, by other antennas, the communication transmission.

To make the features and advantages of the disclosure clear and easy to understand, the following gives a detailed description of embodiments with reference to accompanying drawings.

DESCRIPTION OF THE EMBODIMENTS

Figure 1:
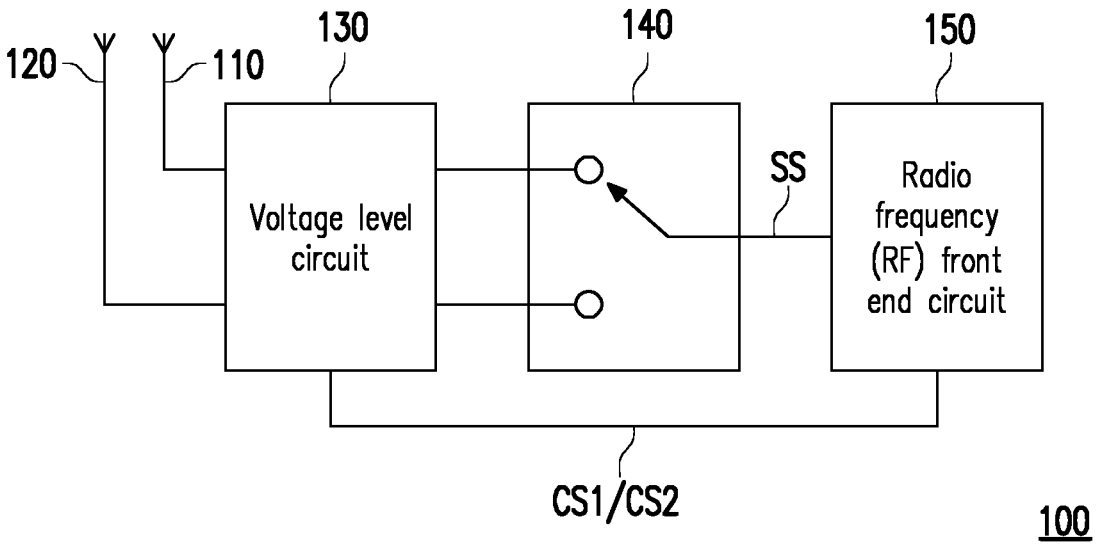
FIG. 1 is a schematic diagram of an antenna device according to an embodiment of the disclosure.

To make the content of the disclosure more comprehensible, embodiments are described below as examples according to which the disclosure can indeed be implemented. Wherever possible, the same reference numbers are used in the drawings and the description to refer to the same or like parts, components or steps.

FIG. 1 is a schematic diagram of an antenna device according to an embodiment of the disclosure. Referring to FIG. 1, an antenna device 100 includes a first antenna 110, a second antenna 120, a voltage level circuit (VLC) 130, a switching circuit 140, and an RF front end circuit 150. The switching circuit 140 is selectively coupled to the first antenna 110 or the second antenna 120. The RF front end circuit 150 is coupled to the switching circuit 140 and is configured to control the switching circuit 140 to couple to one of the first antenna 110 and the second antenna 120 for communication transmission. The voltage level circuit 130 is coupled to the first antenna 110 and the second antenna 120. The voltage level circuit 130 is configured to instantly detect a voltage level of the one of the first antenna 110 and the second antenna 120 to monitor whether the one of first antenna 110 and the second antenna 120 under communication transmission receives electrostatic discharge energy.

In the present embodiment, when the voltage level circuit 130 determines that the voltage level of the one of the first antenna 110 and the second antenna 120 is greater than a threshold voltage, it indicates that the one of the first antenna 110 and the second antenna 120 receive the electrostatic discharge energy. In this regard, the switching circuit 140 switches the one of the first antenna 110 and the second antenna 120 to be opened, and switches the RF front end circuit 150 to couple to another one of the first antenna 110 and the second antenna 120 to continue the communication transmission. Therefore, the antenna device 100 in the present embodiment may provide a good electrostatic discharge protection effect. In addition, in an embodiment, the first antenna 110 and the second antenna 120 may have an overlapping frequency band, so that the antenna device 100 may still maintain a good communication transmission function during the switching of the antenna. In addition, in another embodiment, the first antenna 110 and the second antenna 120 may operate in a same frequency band, for example, operating in a communication band of Wi-Fi, 4G, or 5G, but the disclosure is not limited thereto.

Figure 2:
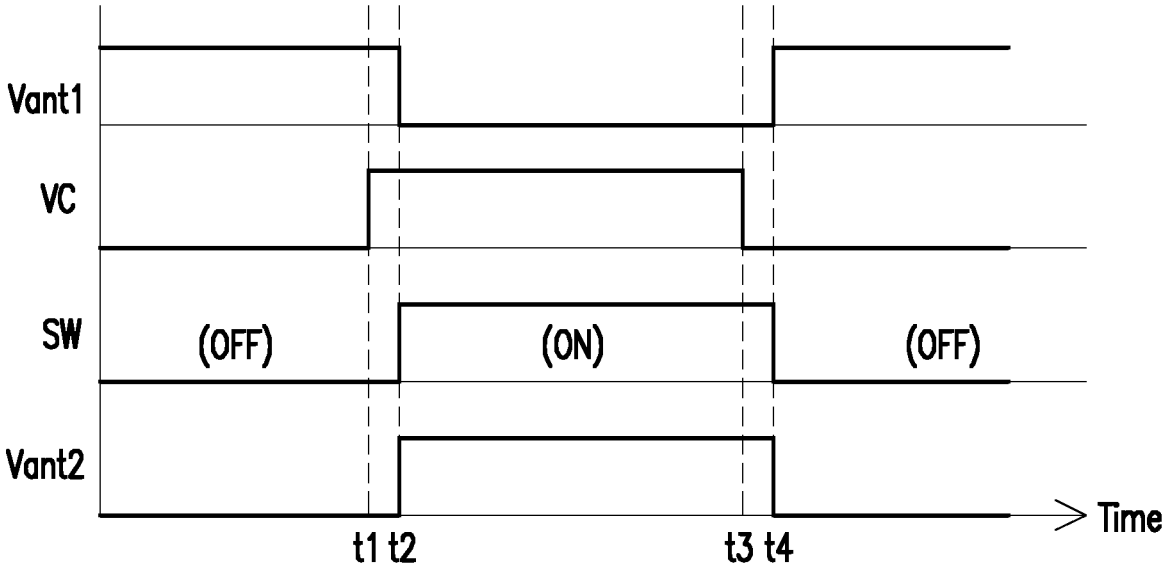
FIG. 2 is a signal waveform diagram of an antenna device according to an embodiment of the disclosure.

FIG. 2 is a signal waveform diagram of an antenna device according to an embodiment of the disclosure. Referring to FIG. 1 and FIG. 2, for example, before time t1, when the RF front end circuit 150 is coupled to the first antenna 110 through the switching circuit 140 for communication transmission, the voltage level circuit 130 may detect that the first antenna 110 has a voltage Vant1 corresponding to a high voltage level of the communication signal. At the time t1, the first antenna 110 receives electrostatic discharge energy (not shown in the figure), so that the voltage level circuit 130 detects that the voltage level of the first antenna 110 is changed. In this embodiment, a change in the voltage Vant1 shown in the figure only represents whether the first antenna 110 is performing communication transmission instead of a voltage changing of the first antenna 110, as well as the voltage Vant2 In addition, when the voltage level exceeds a threshold voltage value, the voltage level circuit 130 determines that the first antenna 110 receives electrostatic discharge energy. Therefore, a voltage VC of the voltage level circuit 130 is changed from a low voltage level to a high voltage level, and a control signal CS1 is output to the RF front end circuit 150 accordingly.

At the time t2, the RF front end circuit 150 may output a corresponding switching signal SS to the switching circuit 140 according to the control signal CS1. The switching circuit 140 switches the first antenna 110 to be disconnected (opened) according to the switching signal SS, that is, a voltage SW of the switching circuit 140 is switched to ON (a high voltage level). In addition, the RF front end circuit 150 is switched to be coupled to the second antenna 120 to continue communication transmission through the second antenna 120. It should be noted that a difference between the time t1 and the time t2 is very small, so that electrostatic discharge energy does not enter the antenna device 100, and a user terminal feels no communication interruption. In addition, because the RF front end circuit 150 no longer performs communication transmission through the first antenna 110, the voltage Vant1 of the first antenna 110 corresponding to the voltage level of the communication signal is changed to a low voltage level, and the second antenna 120 has a voltage Vant2 corresponding to a high voltage level of the communication signal.

Next, at the time t3, when the voltage level circuit 130 detects that the voltage level of the first antenna 110 is recovered to be less than or equal to a threshold voltage, it means that electrostatic discharge of the first antenna 110 ends, and the voltage VC of the voltage level circuit 130 is changed from a high voltage level to a low voltage level, and a control signal CS2 is output to the switching circuit 140, that is, a voltage SW of the switching circuit 140 is switched back to OFF (a low voltage level). Therefore, at the time t4, the switching circuit 140 switches the second antenna 120 to be disconnected (opened), and switches the RF front end circuit 150 to re-couple to the first antenna 110 to continue the communication transmission. It should be noted that a difference between the time t3 and the time t4 is also very small, so that the user feels no communication interruption. In addition, a duration of electrostatic discharge of the first antenna 110 is from the time t2 to the time t4. In this regard, because a process of electrostatic discharge is also quite fast, a difference between the time t2 and the time t4 is also very small.

Accordingly, the antenna device 100 of the present embodiment may automatically determine whether the antenna under communication transmission receives the electrostatic discharge energy, to switch the disconnected antenna under communication transmission to another antenna until the electrostatic discharge is completed, and then switch back to the original antenna for communication transmission, thereby providing an effective electrostatic discharge protection effect, and maintaining the antenna device 100 to continuously perform communication transmission. In some other embodiments, even if the antenna device 100 determines that the antenna (e.g., the first antenna 110) previously performing communication transmission completes the electrostatic discharge, it is still maintained that the antenna (e.g., the second antenna 120) under communication transmission performs communication transmission until the second antenna 120 receives the electrostatic discharge energy.

Figure 3:
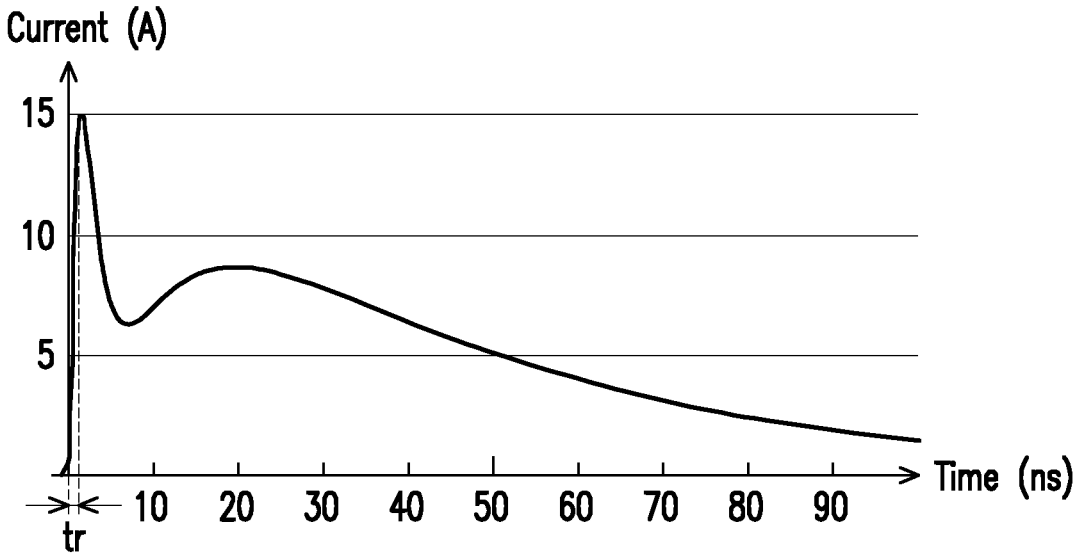
FIG. 3 is a schematic diagram of electrostatic energy discharge according to an embodiment of the disclosure.

FIG. 3 is a schematic diagram of electrostatic energy discharge according to an embodiment of the disclosure. Referring to FIG. 1 to FIG. 3, FIG. 3 illustrates discharge of electrostatic energy of the antenna. In the present embodiment, when the antenna (the first antenna 110 or the second antenna 120) under communication transmission receives electrostatic discharge energy, the voltage level circuit 130 may detect that the voltage level of the antenna changes drastically, and the voltage VC is changed from a low voltage level to a high voltage level. In particular, because the antenna may receive electrostatic discharge current as shown in FIG. 3 within a very short duration tr, the voltage level of the antenna rises suddenly, in which the duration tr may be, for example, several nanoseconds (ns). Therefore, the voltage level circuit 130 determines whether a voltage level of the antenna under communication transmission is greater than a threshold voltage, so that the RF front end circuit 150 may instantly disconnect an antenna under communication transmission within a time less than the duration tr, and switches to the other antenna for communication transmission. In addition, incidentally, because a discharge speed of the electrostatic discharge current is very fast, when the voltage level circuit 130 determines that a voltage level of an antenna under discharge is lower than the threshold voltage, the RF front end circuit 150 may immediately switch the originally coupled antenna for communication transmission after the discharge, to continue the communication transmission. In other words, because a duration for switching the antenna is relatively short, communication quality of the antenna device 100 in the present embodiment is not greatly affected during the switching of the antenna.

Figure 4:
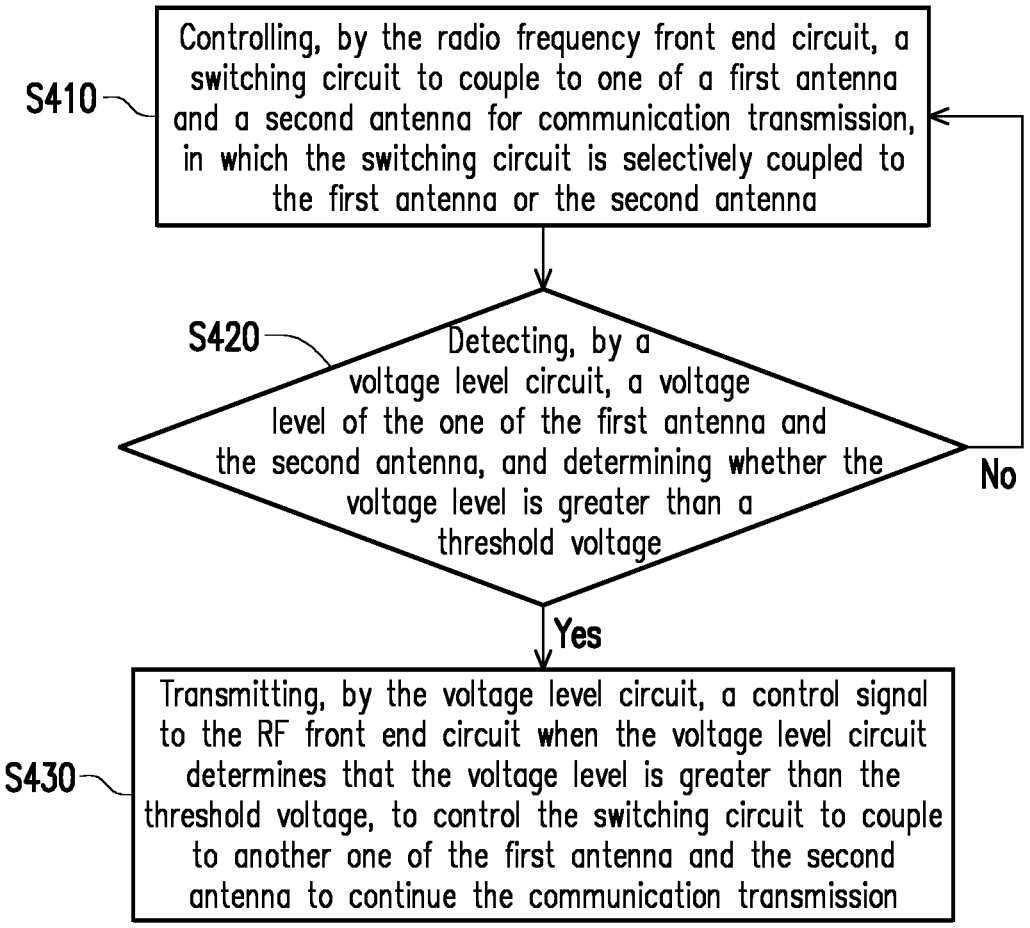
FIG. 4 is a flowchart of an electrostatic discharge protection method according to an embodiment of the disclosure.

FIG. 4 is a flowchart of an electrostatic discharge protection method according to an embodiment of the disclosure. Referring to FIG. 4, the electrostatic discharge protection method of FIG. 4 may be applied to at least the antenna device 100 of FIG. 1, so that the antenna device 100 may achieve electrostatic discharge protection by performing the following steps S410 to S430.

In step S410, the RF front end circuit 150 controls the switching circuit 140 to couple to one of a first antenna 110 and a second antenna 120 for communication transmission, in which the switching circuit 140 is selectively coupled to the first antenna 110 or the second antenna 120.

In step S420, the voltage level circuit 130 detects a voltage level of the one of the first antenna 110 and the second antenna 120, and is configured to determine whether the voltage level is greater than the threshold voltage. If no, the antenna device 100 proceeds to perform step S410, and continues the communication transmission by using the one of the first antenna 110 and the second antenna 120. If yes, the antenna device 100 performs step S430.

In step S430, when the voltage level circuit 130 determines that the voltage level is greater than a threshold voltage, the voltage level circuit 130 transmits a control signal CS1/CS2 to the RF front end circuit 150 to control the switching circuit 140 to couple to another one of the first antenna 110 and the second antenna 120 to continue the communication transmission. Therefore, the electrostatic discharge protection method in the present embodiment may cause the antenna device 100 to have a good electrostatic discharge protection effect.

In addition, sufficient teachings, suggestions, and implementation description may be acquired from descriptions of the embodiments from FIG. 1 to FIG. 3 for the electrostatic discharge protection method and other implementations, technical details, and component features of the antenna device 100 in the present embodiment, and the descriptions thereof are omitted herein.

Based on the foregoing, according to the antenna device with the electrostatic discharge protection function and the electrostatic discharge protection method thereof in the disclosure, the voltage level of the one of the first antenna and the second antenna under the communication transmission may be detected instantly. When the one of the first antenna and the second antenna receives the electrostatic discharge energy, the antenna device of the disclosure may immediately switch the one of the first antenna and the second antenna to be disconnected to prevent the RF front end circuit from causing damage due to receiving of excessive electrostatic discharge energy. In addition, the antenna device in the disclosure may further correspondingly switch to the another one of the first antenna and the second antenna for communication transmission to prevent the communication outage.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. An antenna device with an electrostatic discharge protection function, comprising:

a first antenna;

a second antenna;

a switching circuit, selectively coupled to the first antenna or the second antenna;

a radio frequency (RF) front end circuit, coupled to the switching circuit and configured to control the switching circuit to couple to one of the first antenna and the second antenna for communication transmission; and a voltage level circuit, coupled to the first antenna and the second antenna, the voltage level circuit being configured to detect a voltage level of the one of the first antenna and the second antenna, and configured to determine whether the voltage level of the one of the first antenna and the second antenna is greater than a threshold voltage, wherein in response to the voltage level circuit determining that the voltage level of the one of the first antenna and the second antenna is greater than the threshold voltage, the voltage level circuit transmits a control signal to the RF front end circuit to control the switching circuit to couple to another one of the first antenna and the second antenna to continue the communication transmission.

2. The antenna device according to claim 1, wherein the RF front end circuit outputs a switching signal to the switching circuit according to the control signal, so that the switching circuit performs switching according to the switching signal.

3. The antenna device according to claim 1, wherein when the voltage level of the one of the first antenna and the second antenna is greater than the threshold voltage, the one of the first antenna and the second antenna receives an electrostatic discharge energy.

4. The antenna device according to claim 1, wherein when the voltage level circuit further determines that the voltage level of the one of the first antenna and the second antenna is recovered to be less than or equal to the threshold voltage, the voltage level circuit transmits another control signal to the RF front end circuit to control the switching circuit to re-couple to the one of the first antenna and the second antenna.

5. The antenna device according to claim 1, wherein the first antenna and the second antenna have an overlapping frequency band.

6. An electrostatic discharge protection method of an antenna device, comprising:

controlling, by an RF front end circuit, a switching circuit to couple to one of a first antenna and a second antenna for communication transmission;

detecting, by a voltage level circuit, a voltage level of the one of the first antenna and the second antenna, and determining whether the voltage level of the one of the first antenna and the second antenna is greater than a threshold voltage; and in response to the voltage level circuit determining that the voltage level of the one of the first antenna and the second antenna is greater than the threshold voltage, transmitting, by the voltage level circuit, a control signal to the RF front end circuit and controlling the switching circuit to couple to another one of the first antenna and the second antenna to continue the communication transmission.

7. The electrostatic discharge protection method according to claim 6, wherein the step of controlling the switching circuit to couple to the another one of the first antenna and the second antenna to continue the communication transmission comprises:

outputting, by the RF front end circuit, a switching signal to the switching circuit according to the control signal, so that the switching circuit performs switching according to the switching signal.

8. The electrostatic discharge protection method according to claim 6, wherein when the voltage level of the one of the first antenna and the second antenna is greater than the threshold voltage, the one of the first antenna and the second antenna receives an electrostatic discharge energy.

9. The electrostatic discharge protection method according to claim 6, further comprising:

transmitting, by the voltage level circuit, another control signal to the RF front end circuit when the voltage level circuit further determines that the voltage level of the one of the first antenna and the second antenna is recovered to be less than or equal to the threshold voltage, to control the switching circuit to re-couple to the one of the first antenna and the second antenna.

10. The electrostatic discharge protection method according to claim 6, wherein the first antenna and the second antenna have an overlapping frequency band.

* * * * *